US007645085B2

(12) United States Patent
Liberatore

(10) Patent No.: US 7,645,085 B2
(45) **Date of Patent: *Jan. 12, 2010**

(54) SPREADER APPARATUS, FOR USE WITH DISPENSERS

(75) Inventor: Raymond A. Liberatore, Bentonville, AR (US)

(73) Assignee: Mack-Ray, Inc., Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/329,876

(22) Filed: Dec. 8, 2008

(65) Prior Publication Data

US 2009/0084819 A1 Apr. 2, 2009

Related U.S. Application Data

(60) Continuation of application No. 12/135,121, filed on Jun. 6, 2008, now Pat. No. 7,465,118, which is a continuation of application No. 11/536,851, filed on Sep. 29, 2006, now abandoned, which is a division of application No. 10/628,097, filed on Jul. 28, 2003, now abandoned.

(51) Int. Cl.

| | |
|---|---|
| ***B05C 11/00*** | (2006.01) |
| ***B43K 1/06*** | (2006.01) |
| ***B43K 23/12*** | (2006.01) |
| ***B43M 11/06*** | (2006.01) |
| ***B65D 25/40*** | (2006.01) |

(52) U.S. Cl. ..... 401/266; 401/265; 401/262; 401/183; 222/156

(58) Field of Classification Search ..... 401/183–186, 401/261–266; 222/566

See application file for complete search history.

(56) References Cited

U.S. PATENT DOCUMENTS

| | | | |
|---|---|---|---|
| 708,709 | A | 9/1902 | Henneberry et al. |
| 817,890 | A | 4/1906 | Williams |
| 1,085,566 | A | 1/1914 | Glover |
| 1,604,786 | A | 10/1926 | Rinaldi |
| 1,870,841 | A | 8/1932 | Eckert |
| 1,994,890 | A | 3/1935 | Kallenbach |
| 2,014,149 | A | 9/1935 | Stafford |
| 2,550,132 | A | 4/1951 | Woods |
| 2,716,251 | A | 8/1955 | Pearce |
| 2,804,767 | A | 9/1957 | Schoen |
| 2,888,695 | A | 6/1959 | Anderson et al. |
| 2,930,063 | A | 3/1960 | Stull |

(Continued)

FOREIGN PATENT DOCUMENTS

| | | |
|---|---|---|
| CA | 976113 | 10/1975 |

(Continued)

OTHER PUBLICATIONS

Order Granting Request for Ex Parte Reexamination of US Patent No. 7,314,328, Control No. 90/010,207 date of mailing Aug. 10, 2008 (including Detailed Action).

(Continued)

*Primary Examiner*—David J Walczak
(74) *Attorney, Agent, or Firm*—Myers Wolin, LLC

(57) ABSTRACT

An apparatus for use with an edible food dispenser has a nozzle, a spreader surface associated with the nozzle, and a cap for entirely covering the nozzle.

15 Claims, 3 Drawing Sheets

U.S. PATENT DOCUMENTS

| | | | |
|---|---|---|---|
| 2,982,987 | A | 5/1961 | Knapp |
| 3,063,601 | A | 11/1962 | Hertz |
| 3,090,071 | A | 5/1963 | Le Brody |
| 3,418,059 | A | 12/1968 | Robe |
| 3,963,357 | A | 6/1976 | Crisp |
| 4,225,255 | A | 9/1980 | Braun et al. |
| 4,693,623 | A | 9/1987 | Schwartzman |
| 4,844,917 | A | 7/1989 | DeLorimiere |
| 4,957,226 | A | 9/1990 | Pacia |
| 5,033,650 | A | 7/1991 | Colin et al. |
| 5,097,987 | A | 3/1992 | Liberatore |
| 5,330,075 | A | 7/1994 | Brown, Sr. |
| 5,377,874 | A | 1/1995 | Brown |
| 5,381,935 | A | 1/1995 | Mock |
| 5,588,560 | A | 12/1996 | Benedict et al. |
| 5,685,457 | A | 11/1997 | Liberatore |
| 5,797,692 | A | 8/1998 | Poole et al. |
| 5,823,387 | A | 10/1998 | Manadanas et al. |
| 5,865,555 | A | 2/1999 | Dawson |
| 5,890,630 | A | 4/1999 | Lobdell |
| 5,902,060 | A | 5/1999 | Rodriguez |
| 5,960,994 | A | 10/1999 | Liberatore |
| 6,045,283 | A | 4/2000 | Velasquez et al. |
| 6,076,712 | A | 6/2000 | Esber et al. |
| 6,153,238 | A | 11/2000 | Shannon |
| 6,247,618 | B1 | 6/2001 | Liberatore |
| 2002/0000441 | A1 | 1/2002 | Redmond |

FOREIGN PATENT DOCUMENTS

| | | |
|---|---|---|
| DE | 29 21 633 A1 | 12/1980 |
| GB | 1389205 | 4/1975 |
| WO | 01/96198 | 12/2001 |

OTHER PUBLICATIONS

Order Granting Request for Ex Parte Reexamination of US Patent No. 7,325,994, Control No. 90/010,208 date of mailing Aug. 10, 2008 (including Detailed Action).

Action Closing Prosecution of Reexamination of US Patent No. 7,314,328, Control No. 90/010,207 date of mailing Jul. 29, 2009.

Action Closing Prosecution of Reexamination of US Patent No. 7,325,994, Control No. 90/010,208 date of mailing Jul. 29, 2009.

SPREADER APPARATUS, FOR USE WITH DISPENSERS

CROSS REFERENCE TO RELATED APPLICATIONS

This is a continuation of Ser. No. 12/135,121, filed Jun. 6, 2008, which is a continuation of U.S. application Ser. No. 11/536,851, filed Sep. 29, 2006, now abandoned, which is a division of U.S. application Ser. No. 10/628,097, filed Jul. 28, 2003, now abandoned, each of which are incorporated herein by reference in their entirety.

FIELD OF THE INVENTION

This invention relates generally to flowable material spreaders for use on hand manipulable dispensers, and more particularly to spreaders at the nozzle ends of such dispensers.

BACKGROUND OF THE INVENTION

There is need for means to easily, quickly and accurately spread material such as edible substances, being dispensed from containers such as squeeze tubes or bottles. Typical materials are peanut butter, frosting, butter, mayonnaise, jelly and other edible spreads for use on bread, crackers, and the like. This need extends to elimination of need for a separate knife or spatula, as can become lost on or at outdoor celebrations and picnics, or other events, or need to repeatedly dip a spreader knife into a jar. Material accumulates on the knife and jar edges; also, crumbs or other materials can accumulate in a jar.

SUMMARY OF THE INVENTION

It is a major object of the invention to provide novel and efficient apparatus meeting the above need. Basically, the invention is provided for use with a hand manipulable, flowable material dispenser, and comprises:

a) a dispensing nozzle associated with the dispenser to dispense said material, b) and a spreader surface associated with the nozzle whereby the dispenser may be manipulated to cause the spreader surface to spread material dispensed via the nozzle, and the spreader surface can be used to spread the material in desire positions, used as a built-in spatula or knife without squeezing the material out. Also, the invention enables squeezing and spreading at the same time; or spreading only, as a built-in knife and spatula.

As will be seen the spreader surface has the form of a blade, or flap or spatula surface proximate the nozzle exit, to shape and spread or move around the material being dispensed. The spreader may be stiff or flexible, as will appear, and is typically laterally elongated or curved to encompass the width of a layer of material being dispensed. The nozzle itself can be flexible, to aid in utility of desired spreading of the material being dispensed.

Additional objects include provision of a spreader nozzle that is attachable as a cap to the exit end of a container of the material being dispensed; threaded, permanent or snap-on attachment of the spreader nozzle to the container; the provision of a serrated laterally extending edge on the spreader, thereby to form striations on a layer of dispensed material; the provision of a serrated edge at the discharge end of the nozzle; and the provision of a spreader with movement adjusted on the nozzle, as will be seen.

DETAILED DESCRIPTION

Figure 1:
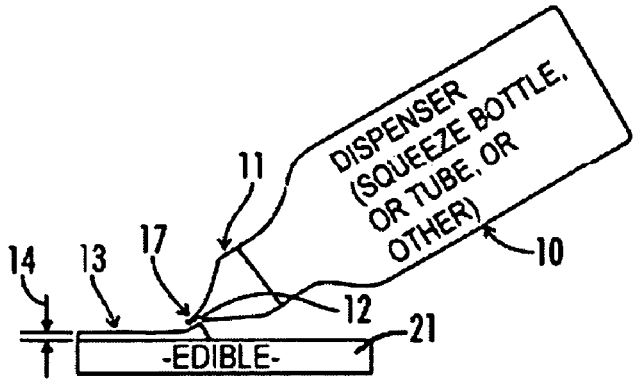
FIG. 1 is a side view of a spreader.
Figure 2:
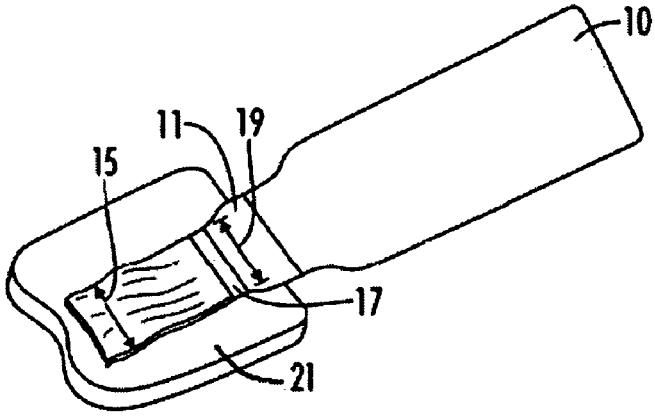
FIG. 2 is a perspective top view of the FIG. 1 spreader.

In FIGS. 1 and 2, a dispensing container 10 contains dispensable, flowable food material such as peanut butter, jelly or other such edibles such as referred to above. When the container is squeezed, the material flows through a nozzle 11 which tapers toward an outlet 12, which is elongated laterally, to provide a dispensed layer 13 of material of thickness 14 substantially less than its width 15. A flexible spreader 17 in the form of a flap or blade, or spatula, is provided at the nozzle exit, to face the layer 13 exiting from the nozzle, whereby the user can manipulate the spreader, and its undersurface, via container manipulation, to further spread or shape the dispensed layer 13. The flap or blade may be stiff or sufficiently flexible to shape the layer 13. Note its lateral length 19 substantially greater than its width.

Figure 4:
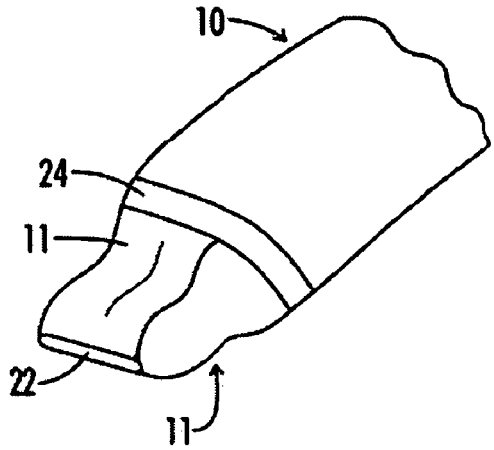
FIG. 4 is a view like FIG. 2, but showing a spreader flexible dispensing nozzle.
Figure 3:
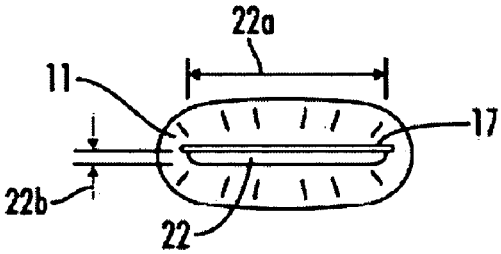
FIG. 3 is a frontal view of a spreader dispensing opening.

The nozzle 11 may be stiff or may be flexible as in FIG. 4 to assist flexing of the spreader during container manipulation to cause the spreader to shape the layer 13 deposited on a surface 21 or spread it only after it is dispensed. The latter may be a food surface such as on bread, or other substances. FIG. 3 shows the nozzle outlet 22, which has lateral width 22*a* substantially greater than its thickness 22*b*. The nozzle may be a cap on the container, or may be integral with the container. A snap-on or threaded fitting 24 connects the nozzle to the container, in FIG. 4. FIG. 4 also shows the nozzle outlet 22 having a linear edge profile along the lateral width dimension 22*a* (see FIG. 3) of the periphery when the outlet 22 is viewed from the side of the nozzle 11, the linear edge profile defined at a constant distance from the fitting 24 along the lateral width dimension 22*a* along a central axis of the nozzle 11, the central axis of the nozzle extending perpendicular to the nozzle outlet 22 from the fitting 24 to the nozzle outlet 22. FIG. 4 also shows that the forwardly-projecting side wall is configured to funnel dispensed material from the fitting 24 to the nozzle outlet 22. FIG. 4 also shows a nozzle 11 wherein the distance from the nozzle outlet 22 to the fitting 24 exceeds a thickness of the fitting 24.

Figure 5:
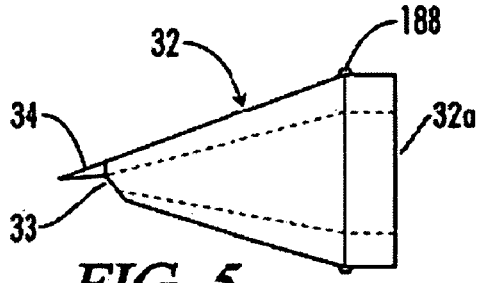
FIG. 5 is a side view of a spreader nozzle.
Figure 6:
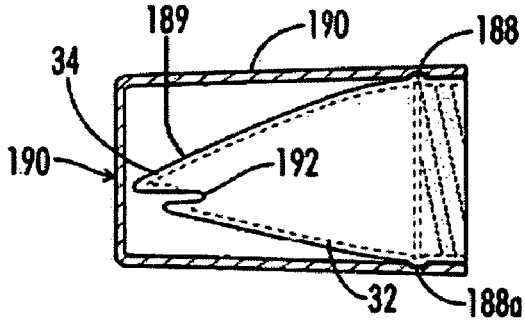
FIG. 6 is a top plan view of a spreader cap.
Figure 7:
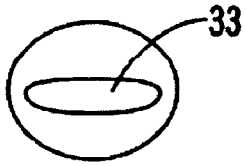
FIG. 7 is a view of an entrance at the inlet end of a spreader as in FIG. 5.
Figure 8:
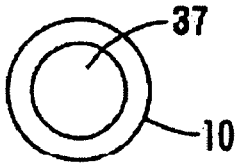
FIG. 8 is like FIG. 7, showing a different entrance configuration.
Figure 9:
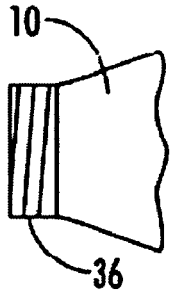
FIG. 9 is a side elevation showing the end of a container to which a spreader cap attaches.
Figure 10:
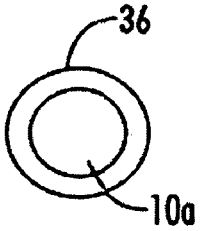
FIG. 10 is a frontal view of the FIG. 9 container end.

FIGS. 5 and 6 show a nozzle 32, tapering toward a narrowed exit 33 with a spreader flap or blade 34 overhanging that exit. FIG. 6 shows a cap 190 that receives the nozzle with snap-ring retention at 188 in a cap recess 188*a* of nozzle end 32*a*. Cap inner wall 189 forms a recess to receive the nozzle. A plug 192 on the cap plugs outlet 33. FIG. 7 shows the exit 33 as laterally, elongated with narrowed width or height. The nozzle entrance is seen at 87, in FIG. 8. FIG. 9 shows dispenser threads 36 to which the nozzle may threadably or otherwise attach. FIG. 10 shows in frontal view the annular end of the thread 36. See end opening 10*a*.

Figure 11:
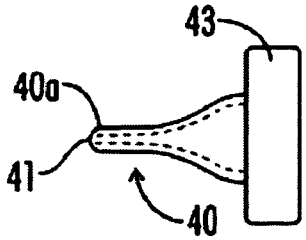
FIG. 11 is a side elevation showing a spreader or narrowed configuration.
Figure 12:
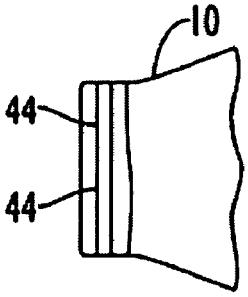
FIG. 12 is a side elevation of the discharge end of a container to which the FIG. 11 spreader attaches.

FIG. 11 shows a flexible nozzle 40 that tapers toward an outlet 41, such as an elongated slit. The nozzle tip 40*a* serves as a spreader. The nozzle has a fitting 43 that threadably attaches to dispenser threads 44, as seen in FIG. 12.

Figure 13:
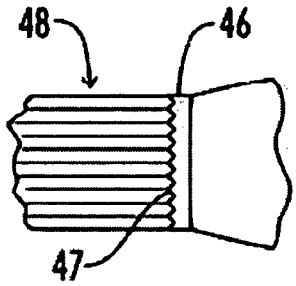
FIG. 13 is a top plan view of a spreader discharge end, with a serrated edge.
Figure 14:
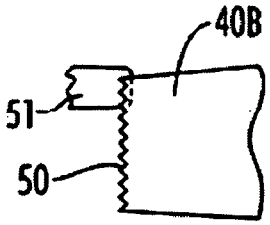
FIG. 14 is a view like FIG. 13 showing a nozzle discharge end with serrated edge.

FIG. 13 shows a spreader flap 46 that has a laterally elongated serrated edge 47 to engage the dispensed layer 48 being dispensed. As a result, the layer 48 has an attractive striated appearance. The nozzle can be waved laterally back and forth to produce wavy elongated striations on the dispensed layer surface. FIG. 14 shows similar serrations 50 on the end of a nozzle 40*b*. A flap 51 can be attached to the nozzle to overlie the serrations, or part of same.

Figure 15:
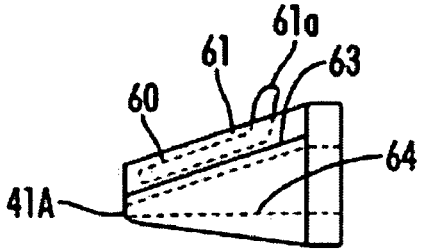
FIG. 15 is a side elevation showing a nozzle with a retracted movable spreader, and control.
Figure 16:
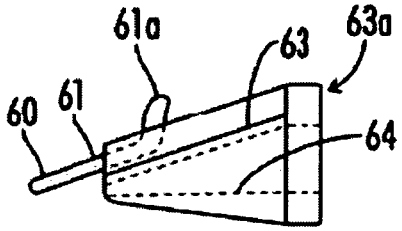
FIG. 16 is a view like FIG. 15, showing the movable spreader in extended position.
Figure 17:
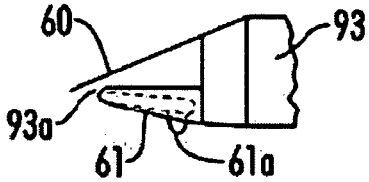
FIG. 17 is like FIG. 15, but showing the movable retractable spreader at the underside of the nozzle.
Figure 18:
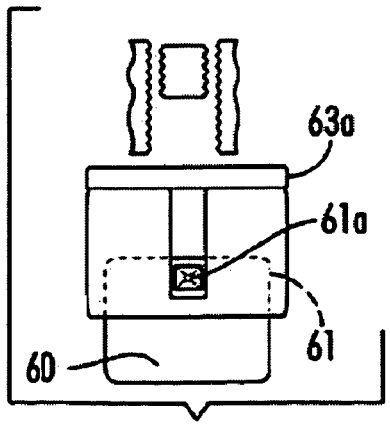
FIG. 18 is a top plan view of a nozzle with an associated retractable and extendable spreader.

In FIG. 15, the flap or blade 60 is carried for adjustable movement, as by a carrier or adjuster 61 on the nozzle. A finger engagable protrusion 61*a* on the carrier is manipulated to move or slide the blade and carrier toward or away from the nozzle exit 41*a*, thereby to adjust the exposure of the blade to the dispensed material, to provide additional flexibility of use of the blade. Grooving 63 in the nozzle in the form of a threaded cap 63*a*, guides the adjuster. FIG. 16 shows the blade in extended forward position. The dispensing nozzle cavity appears at 64. FIG. 18 is a top plan view of the FIG. 16 adjuster. FIG. 17 shows the adjuster at the bottom side of the nozzle 93, having an exit 93*a*, and pusher. The option of depositing the layer 113 without interference with the spreader flap or blade, is preserved.

Figure 19:
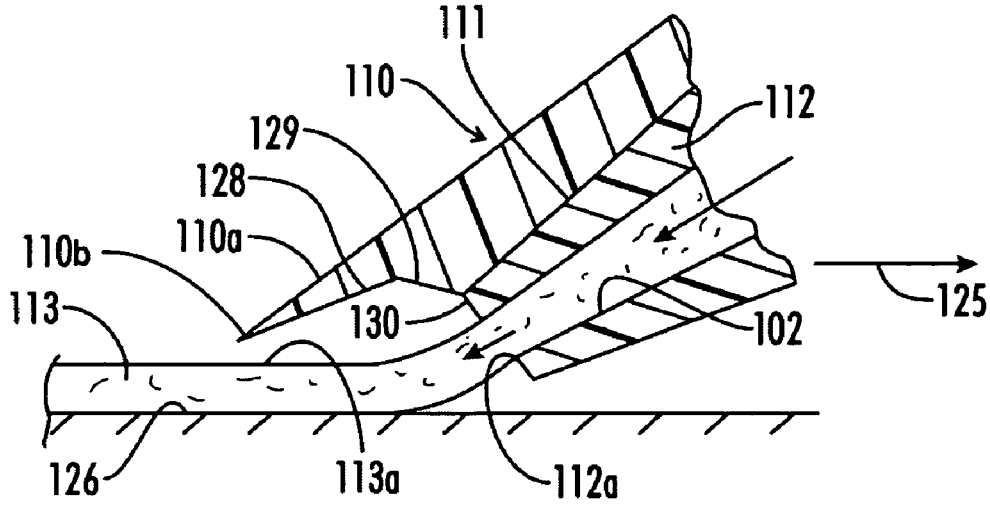
FIG. 19 shows a modified nozzle and spreader.

In FIG. 19, a spreader 110 blade or flap 110*a* carried at 111 by, and may be fixedly or releasably attached to or integral with, a nozzle 112. See bond zone at 111. The spreader and nozzle are shown being moved to the right. See arrow 125, and a layer of dispensable material 113 is deposited on substrate 126, via bore 102 of the nozzle. Material 113 is typically edible, and may consist for example of peanut butter, butter, frosting, mayonnaise, jam, jelly, soft cheese, or other edibles.

In FIG. 19, the spreader 110 as supported is angled, relative to the nozzle or its bore, so that the spreader flap terminal 110*b* is sufficiently offset from the nozzle outlet 112*a* by a sufficient distance, that the terminal tip 110*b* does not engage the top 113*a* of the deposited layer 113, as during depositing of the layer. Terminal 110*b* may consist of an elastomer such as rubber. Outlet 112*a* may be laterally elongated as in FIG. 7.

Figure 19A:
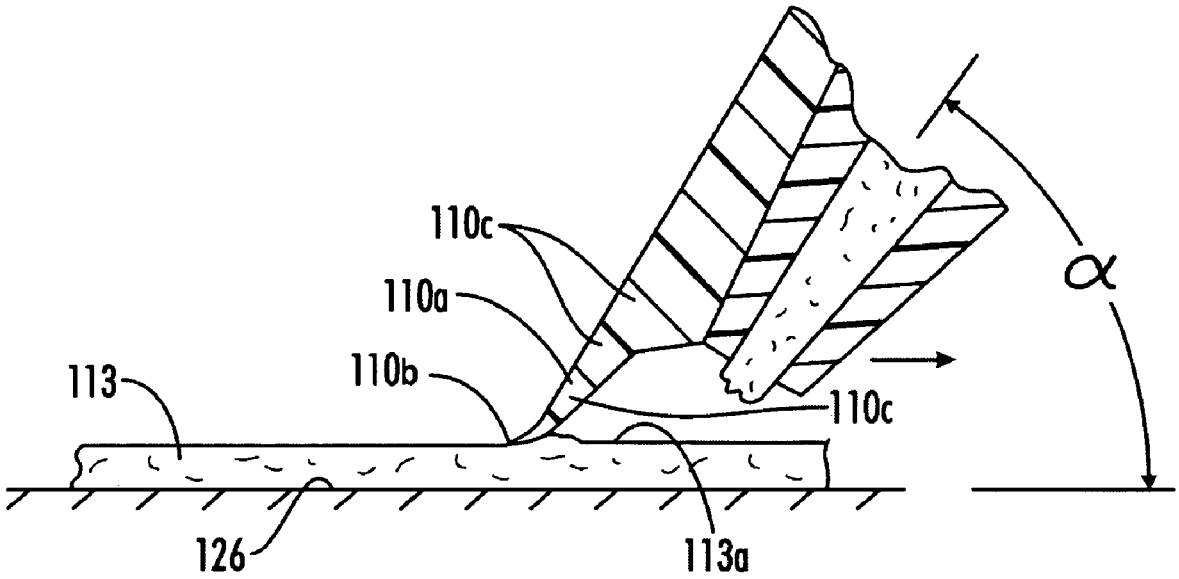
FIG. 19*a* shows the FIG. 19 spreader in tilted position, for spreading use.

In FIG. 19*a* the nozzle is now further tilted, as at angle $\alpha$, so that the spreader blade terminal tip 110*b* engages the surface of the layer 113, for spreading purposes. Terminal 110*b* is shown as arcuately flexed near the tip, to smoothly engage and spreadably deform surface 113*a*, as the nozzle is moved to the right, relative to 113. Note that the spreader body at 110*c* upwardly of terminal 110*b* is thickened so as not to flex, and so as to positively position the terminal 110*b* as it accurately wipes along surface 113*a*. Terminal 110*b* may or may not be flexible, but is preferably arcuately flexible to smooth and spread surface 113*a*, as the nozzle and supply container are manipulated.

Body 110*c* tapers toward the tip or terminal. This construction, as shown, lends itself to ease of cleaning of interior surfaces 128, 129, and 130, as well as cleaning of the terminal. Note the greater than 90° angularities of adjacent surfaces 128 and 129, and 129 and 130, avoiding small gaps. The spreader terminal at 110*b* may have elongated lateral length, of dimension substantially greater than the nozzle discharge opening dimension, as described above in other Figures, for engaging the widened surface area of 113, achieved during spreading.

Figure 20:
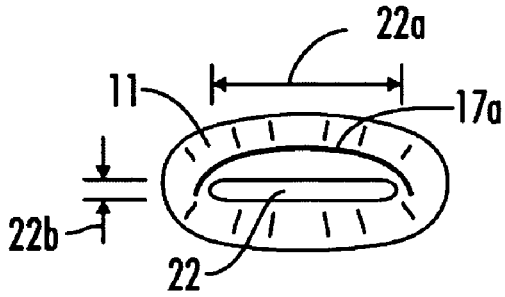
FIG. 20 shows a curved flap or blade.

FIG. 20 shows a curved flap or blade to conform to curvature of an edible, such as a corn cob. See laterally elongated nozzle outlet 22 having narrowed width 22*b*. A downwardly concave spreader flap or blade 17*a* is shown as above the outlet 22, and of lateral elongation greater than outlet 22 lateral elongation, indicated at 22*a*.

The invention includes the following, as for example is disclosed above and in the drawings, for use with a hand manipulable, flowable, edible and spreadable material dispenser:

a) a dispensing nozzle associated with the dispenser to dispense said material, b) and a spreader surface associated with the nozzle whereby the dispenser may be manipulated to cause the spreader surface to spread material dispensed via the nozzle, c) said surface having the form of a spreader shelf carried by the dispenser and projecting forwardly, relative to the nozzle, the shelf connected to the dispenser, d) the nozzle defining an outlet, the outlet and shelf having lateral widths substantially in excess of three times the thickness of the outlet, whereby as said material is dispensed forwardly through the aperture and over the shelf it becomes spread over the width of the shelf and beyond the shelf for spreading as a wide layer deposited on an edible, e) and protective structure extending crosswise of the nozzle in forwardly spaced proximate relation to the outlet and extending across the entire width of the outlet, said structure carried by the dispenser to project in the direction of the shelf and above the level of the shelf during said layer depositing.

I claim:

1. A nozzle for attachment to a dispenser for dispensing material, the nozzle comprising:

a) a fitting at a first end to facilitate attachment to the dispenser;

b) an opening at a second end opposite the first end through which material is dispensed, a center of the opening being located along a central axis of the nozzle, the fitting being wider than the opening, the opening defining a periphery having a lateral width dimension and a height dimension, the opening further comprising arcuate and concave surfaces at widthwise opposite ends that remain of fixed dimension to define an oval periphery, the lateral width dimension substantially exceeding twice the height dimension of the opening; and c) a forwardly-projecting side wall extending from the first end to the opening, the side wall having a peripheral outer surface defined by a concave surface that transitions into an outwardly rounded convex surface that terminates at the opening;

d) wherein the side wall further comprises an upper wall and a lower wall, each of the upper and lower walls comprising a portion of the peripheral outer surface such that each of the upper and lower walls comprises a concave surface that transitions into an outwardly rounded convex surface terminating at the opening, e) whereby a substantially constant layer of material is dispensed through the opening and having a width of the opening.

2. A nozzle in accordance with claim 1, wherein the concave surface is closer to the central axis than the fitting.

3. A nozzle in accordance with claim 1, wherein the fitting defines the widest portion of the nozzle, and the concave surface along the forwardly projecting sidewall defines the narrowest of the nozzle between the fitting and the outwardly rounded convex surface.

4. A nozzle in accordance with claim 1, further comprising a cap for covering the nozzle during periods of non-use, a portion of the cap extending around the opening.

5. A nozzle in accordance with claim 4, a portion of the cap extending into the opening for plugging the opening.

6. A nozzle in accordance with claim 1, further comprising a compressible dispenser attached to the nozzle.

7. A dispensable product comprising a dispenser for holding material to be dispensed and a nozzle for attachment to the dispenser and through which material is dispensed, the nozzle further comprising:

a) a fitting at a first end to facilitate attachment to the dispenser;

b) an opening at a second end opposite the first end through which material is dispensed, a center of the opening being located along a central axis of the nozzle, the fitting being wider than the opening, the opening defining a periphery having a lateral width dimension and a height dimension, the opening further comprising arcuate and concave surfaces at widthwise opposite ends that remain of fixed dimension to define an oval periphery, the lateral width dimension substantially exceeding twice the height dimension of the opening; and c) a forwardly-projecting side wall extending from the first end to the opening, the side wall having a peripheral outer surface defined by a concave surface that transitions into an outwardly rounded convex surface that terminates at the opening;

d) wherein the side wall further comprises an upper wall and a lower wall, each of the upper and lower walls comprising a portion of the peripheral outer surface such that each of the upper and lower walls comprises a concave surface that transitions into an outwardly rounded convex surface terminating at the opening, e) whereby a substantially constant layer of material is dispensed through the opening and having a width of the opening.

8. A dispensable product in accordance with claim 7, wherein the concave surface is closer to the central axis than the fitting.

9. A dispensable product in accordance with claim 7, wherein the nozzle is threadingly attached to the dispenser.

10. A dispensable product in accordance with claim 7, wherein the fitting defines the widest portion of the nozzle, and the concave surface along the forwardly projecting sidewall defines the narrowest portion of the nozzle between the fitting and t e outwardly rounded con ex surface.

11. A dispensable product in accordance with claim 7, further comprising a cap for covering the nozzle during periods of non-use, a portion of the cap extending around the opening.

12. A dispensable product in accordance with claim 11, a portion of the cap extending into the opening for plugging the opening.

13. A dispensable product in accordance with claim 7, further comprising material that is a spreadable food product.

14. A dispensable product in accordance with claim 13, further comprising material that is at least one of peanut butter, butter, frosting, mayonnaise, jam, jelly, or soft cheese.

15. A nozzle for attachment to a dispenser for dispensing material, the nozzle comprising:

a) a fitting at a first end to facilitate attachment to the dispenser;

b) an opening at a second end opposite the first end through which material is dispensed, a center of the opening being located along a central axis of the nozzle, the fitting being wider than the opening, the opening defining a periphery having a lateral width dimension and a height dimension, the opening further comprising arcuate and concave surfaces at widthwise opposite ends that remain of fixed dimension to define an oval periphery, the lateral width dimension substantially exceeding twice the height dimension of the opening; and c) a forwardly-projecting side wall extending from the first end to the opening, the side wall having a peripheral outer surface defined by a concave surface that transitions into an outwardly rounded convex surface that terminates at the opening, the concave surface being closer to the central axis than the convex surface;

d) wherein the side wall further comprises an upper wall and a lower wall, each of the upper and lower walls comprising a portion of the peripheral outer surface such that each of the upper and lower walls comprises a concave surface that transitions into an outwardly rounded convex surface terminating at the opening, each concave surface being closer to the central axis than each outwardly rounded convex surface; and e) whereby a substantially constant layer of material is dispensed through the opening and having a width of the opening.

* * * * *